US007780171B2

(12) United States Patent
Mukasa et al.

(10) Patent No.: US 7,780,171 B2
(45) Date of Patent: Aug. 24, 2010

(54) GAME MACHINE

(75) Inventors: Shigehito Mukasa, Tokyo (JP); Koki Atobe, Tokyo (JP); Hironori Takahashi, Tokyo (JP); Kazufumi Koike, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 121 days.

(21) Appl. No.: 12/090,265

(22) PCT Filed: Oct. 25, 2006

(86) PCT No.: PCT/JP2006/321803

§ 371 (c)(1),
(2), (4) Date: Nov. 17, 2008

(87) PCT Pub. No.: WO2007/049791

PCT Pub. Date: May 3, 2007

(65) Prior Publication Data

US 2009/0224481 A1 Sep. 10, 2009

(30) Foreign Application Priority Data

Oct. 28, 2005 (JP) ..... 2005-314973

(51) Int. Cl.
*A63B 67/00* (2006.01)

(52) U.S. Cl. ..... 273/440; 273/368

(58) Field of Classification Search ..... 273/351, 273/354, 359, 367, 368, 440; 463/7
See application file for complete search history.

(56) References Cited

U.S. PATENT DOCUMENTS

| | | | | |
|---|---|---|---|---|
| 4,461,475 | A | 7/1984 | Nakamura et al. | |
| 4,524,967 | A * | 6/1985 | Hanson et al. | 273/440 |
| 5,887,872 | A * | 3/1999 | Keifer et al. | 273/273 |
| 6,463,859 | B1 * | 10/2002 | Ikezawa et al. | 104/53 |

FOREIGN PATENT DOCUMENTS

| | | |
|---|---|---|
| EP | 0700700 | 3/1996 |
| JP | 05-293247 | 11/1993 |
| JP | 05-293248 | 11/1993 |

(Continued)

*Primary Examiner*—William M Pierce
(74) *Attorney, Agent, or Firm*—Peter C. Schechter; Brian R. Landry; Edwards Angell Palmer & Dodge LLP

(57) ABSTRACT

A game machine (1) includes a game board (3) having a housing section opened on a game surface, a target which is provided to the housing section so as to freely appear and disappear, and a target driving mechanism which is provided into the game board and allows the target (9) to appear and disappear from and into the housing section. The game machine is provided with a supporting pedestal (2) which supports the game board, a rotation driving device (20) which rotates the game board supported to the supporting pedestal about a pivot axis line RC extending to a direction where the line crosses the board surface in a reciprocating manner, and a tilt giving mechanism which is provided between the supporting pedestal and the game board and gives a motion to the game board according to the rotating motion of the game board about the pivot axis line RC so that the game board tilts with respect to the pivot axis line.

11 Claims, 14 Drawing Sheets

FOREIGN PATENT DOCUMENTS

| | | |
|---|---|---|
| JP | 06-083088 | 11/1994 |
| JP | 07-328222 | 12/1995 |
| JP | 11-226238 | 8/1999 |
| JP | 2001-204956 | 7/2001 |
| JP | 2002-200330 | 7/2002 |
| TW | M243255 | 9/2004 |
| TW | M243256 | 9/2004 |

* cited by examiner

GAME MACHINE

CROSS-REFERENCE TO PRIOR APPLICATIONS

This is a U.S. national phase application under 35 U.S.C. §371 of International Patent Application No. PCT/JP2006/321803, filed Oct. 25, 2006, and claims the benefit of Japanese Application No. 2005-314973, filed Oct. 28, 2005, both of which are incorporated by reference herein. The International Application was published in English on May 3, 2007 as International Publication No. WO 2007/049791 A2 under PCT Article 21(2).

TECHNICAL FIELD

The present invention relates to a game machine such as a whack-a-mole game machine, in which targets are protruded at arbitrary time from a housing section provided to a game board over a board surface of the game board so as to challenge a player for hitting the targets.

RELATED ART

As such type of game machines, game machines are provided to the public (for example, see JP1999-A-226238 and JP 2002-A-200330), in which a game board of housing targets is fixed to a case body of the game machine. Another game machine is also proposed (for example, JP1994-U-83088), in which motions of targets are diversified by rotating the game board about a horizontal axis line, thereby to resolve monotonousness of the game.

DISCLOSURE OF THE INVENTION

In a configuration of rotating the game board about the horizontal axis line; however, the movement of the game board is limited to in a direction about the rotation axis line. Thus, the diversity of the motions of the targets is also limited.

Accordingly, it is an object of the present invention to provide a game machine in which unpredictability of motions of targets are improved by further diversifying the motions of the targets than the conventional one thereby to enhance the appeal of the game.

In order to address the above object, the present invention provides a game board having a board surface and a housing section opened on the board surface; a target which is provided to the housing section so as to freely appear and disappear; a target driving mechanism which is provided into the game board and drives the target between a position where the target protrudes from the housing section and a position where the target retreats into the housing section; a supporting pedestal which supports the game board; a rotation driving device which rotates the game board supported by the supporting pedestal about a pivot axis line extending to a direction where the line crosses the board surface in a reciprocating motion; and a tilt giving mechanism which is provided between the supporting pedestal and the game board and gives a motion for tilting with respect to the pivot axis line to the game board according to a rotating motion of the game board about the pivot axis line.

According to the game machine of the present invention, the game board can be driven to rotate about the pivot axis line by the rotation driving device. Further, when the tilt giving mechanism tilts the game board with respect to the pivot axis line along with the rotating motion, the board surface rotates about the pivot axis line and also its tilt can be changed suitably. When the target is allowed to appear and disappear from and into the housing section according to the motion of the game board surface, various motions are given to the target, and unpredictability of the motion of the target is increased thereby to improve an appeal of the game.

In an embodiment of the present invention, the rotation driving device may have an output shaft which is arranged on the pivot axis line, a driving source which drives to rotate the output shaft, and a connector which allows a tilt of the game board to all directions with respect to the pivot axis line and simultaneously connects the output shaft and the game board so as to be capable of rotating integrally. According to this configuration, since the output shaft of the rotation driving device and the game board can be connected, the rotation of the rotation driving device can be transmitted to the game board efficiently. Since the game board can be restrained to the pivot axis line by using the rotation driving device, wobbling of the game board can be easily suppressed when the game board 3 rotates, thereby to improve the stability of the rotating motion with relative ease. As to the tilt of the game board with respect to the pivot axis line, it is only necessary to support the game board on the supporting pedestal in at least another point since the game board is restrained by the connector. Therefore, the supporting mechanism of the game board is simplified easily.

In an embodiment of the present invention, the tilt giving mechanism may have a guide member which has a guide surface extending about the pivot axis line and is provided to any one of the supporting pedestal and the game board, and a guided member which is provided to the other one of the supporting pedestal and the game board and contacts with the guide surface of the guide member, and the guide surface may have a difference of elevation in a direction of the pivot axis line. According to this configuration, when the game board is rotated, the guided member relatively moves on the guide member along the guide surface, so that the guided member relatively shifts to a direction of the pivot axis line with respect to the guide member according to the difference of elevation on the guide surface. The tilt of the game board can be changed using this shift.

Further in the above mentioned embodiment, the guide surface may be configured so that a contact position of the guided member at the time when the game board is in a neutral position at the middle of a rotating range is a bottom, and as the game board separates from the bottom to farther its rotating direction, its height increases. According to this configuration, as the game board rotates with respect to the neutral position, a larger tilt is given to the game board, so that the motion of the target can be changed more dynamically.

In an embodiment of the present invention, the game machine may further comprise a lift mechanism which elevates the game board so that the guided member is separated from the guide surface. According to this configuration, when the game board is lifted by the lift mechanism, the tilt of the game board can be further changed without being limited to the change in the tilt of the game regulated by the guide member and the guided member. Accordingly, the motion of the target can be further diversified. Moreover, the lift mechanism can be used for dramatizing the game with the motion of the game board.

In an embodiment of the present invention, when the game board is in the neutral position at the center of the rotating range, a tilt may be given to the board surface of the game board so that the game board tilts forward and downward with respect to a player, and the target may be allowed to appear and disappeared from and into the board surface in an approximately up-down direction. According to this configuration, when the game board which tilts forward and downward is rotated with respect to the neutral position, the board surface is tilted in one side to a diagonal direction with respect to the player, and the tilt is further varied by a tilt given by the tilt giving mechanism. Accordingly, the target which moves toward the player's side in the neutral position changes its motion to different directions, and thus the player is requested to change the way of hitting the target. Through these changes, monotonous motions of the targets are diversified, and the appeal of the game can be enhanced.

EFFECT OF THE INVENTION

As described above, according to the game machine of the present invention, the board surface can be not only rotated about the pivot line axis line but also tilted arbitrarily, by driving the game board to rotate about the pivot axis line with the rotation driving device and tilting the game board relative to the pivot axis line with the tilting mechanism in accordance with the rotational motion. By allowing the targets to appear and disappear from and into the housing section in accordance with the motion of the game board surface, various motions can be given to the targets, and unpredictability of the motions of the targets can be improved, thereby to enhance the appeal of the game.

BEST MODE FOR CARRYING OUT THE INVENTION

Figure 1:
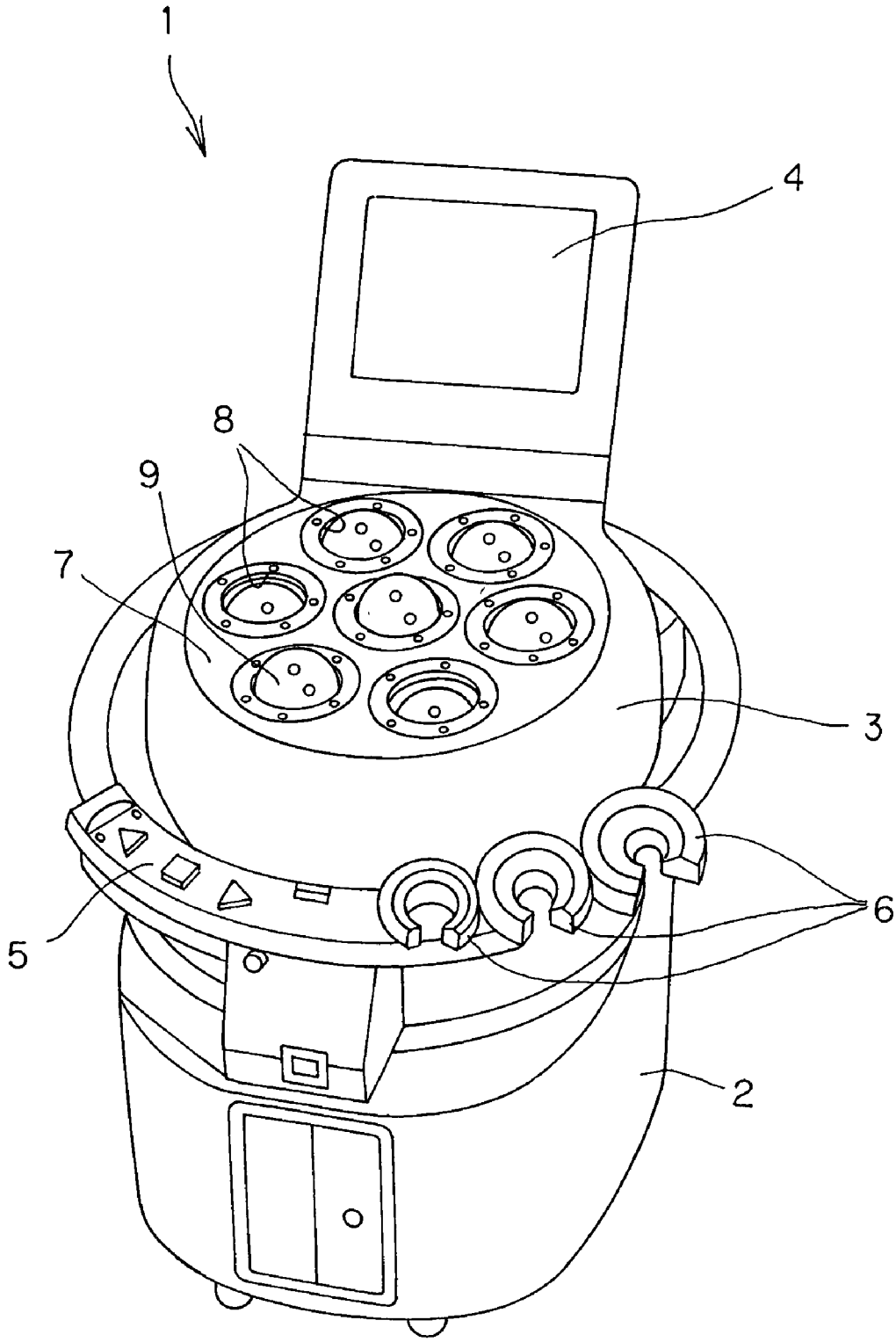
FIG. 1 is a perspective view of a game machine according to an embodiment of the present invention.
Figure 2:
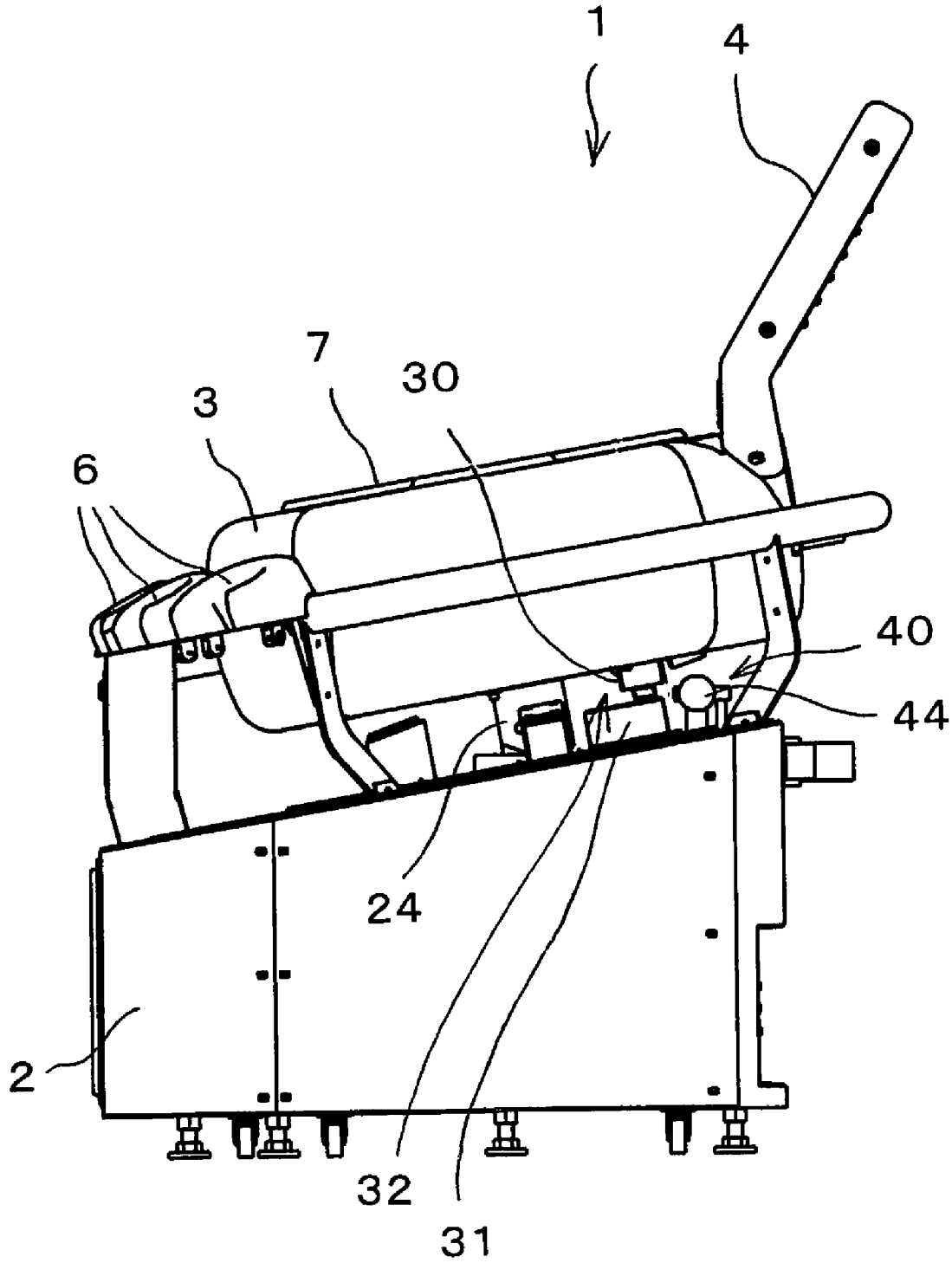
FIG. 2 is a right side view of the game machine.

FIG. 1 is a perspective view of a game machine according to an embodiment of the present invention; FIG. 2 is a right side view of the game machine. As shown in FIGS. 1 and 2, the game machine 1 has a supporting pedestal 2, a game board 3 arranged on the supporting pedestal 2, and a display 4 arranged behind the game board 3. The supporting pedestal 2 is a part to be a base of the game machine 1, and is placed on the floor of a shop or the like. An operation board 5 for accepting player's operations is arranged on a front end of an upper side of the supporting pedestal 2, and multiple hammer holders 6 are arranged on a right side of the operation board 5. Hammers (not shown), whose sizes and masses differs, are attached removably to the hammer holders 6. The display 4 is employed to instruct a player in operations, to provide game information, to display images for dramatizing a game, or the like.

A board surface 7 is arranged on an upper surface of the game board 3. Multiple (seven in FIG. 1) hole portions 8 are opened on the board surface 7; and a target 9 is arranged in the respective hole portion 8. The respective target 9 is able to appear and disappear freely through the hole portion 8. In the game machine 1 of this embodiment, the respective target 9 protrudes from the hole portions 8 at an arbitrary timing, and a game score varies depending on whether the player can hit the protruded targets 9 with the hammer. For a mechanism for driving the targets 9, a well known mechanism may be used. An example of the mechanism is described later.

Figure 3:
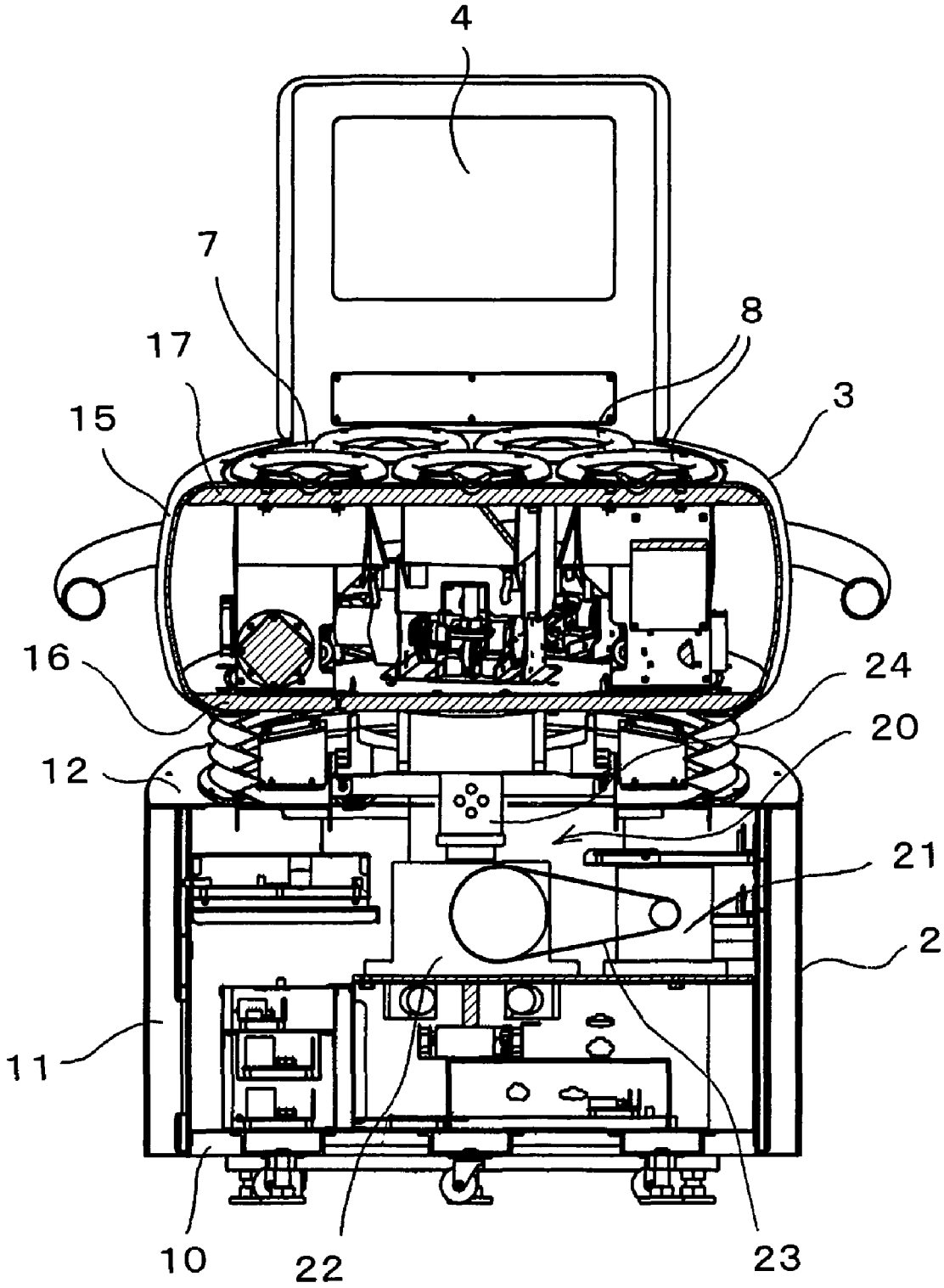
FIG. 3 is a partially cut-away front view of the game machine.
Figure 4:
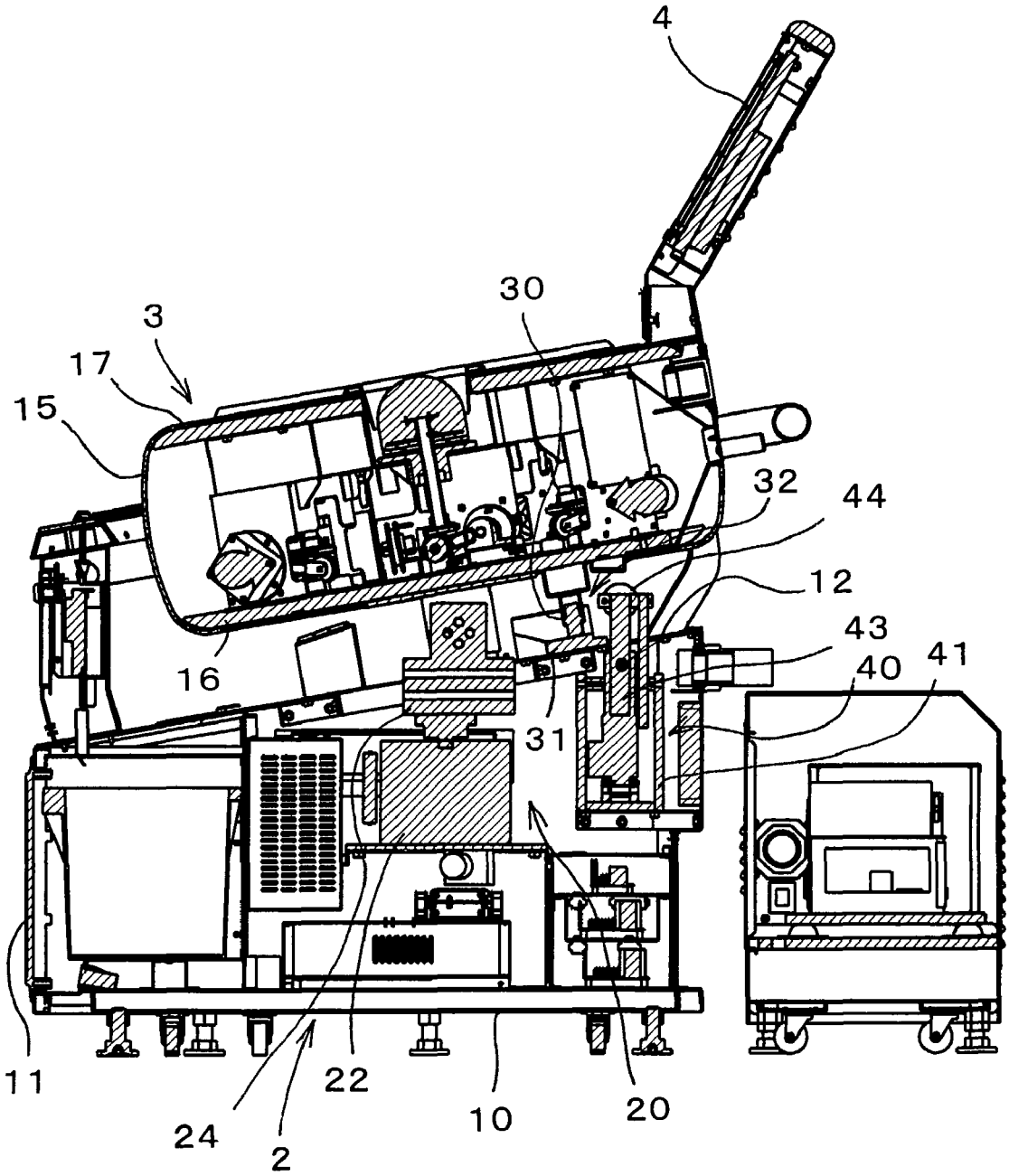
FIG. 4 is a vertical cross-sectional view of the game machine along a front-rear direction.

FIG. 3 is a partially cut-away front view of the game machine 1; and FIG. 4 is a vertical cross-sectional view of the game machine 1 taken along the front-rear direction. As shown in FIGS. 3 and 4, the supporting pedestal 2 and the game board 3 are configured as individual separate case bodies. The supporting pedestal 2 is configured by suitably combining a bottom plate 10, a wall plate 11 and a top plate 12. The top plate 12 is tilted downwardly toward its front end (toward the left in FIG. 4). The game board 3 is supported by the top plate 12. The game board 3 is configured in a shape of a barrel container, which is composed from a body section 15 which swells more at its central portion than at its upper and lower ends, a bottom plate 16 which is fitted in the lower end of the body section 15 and a top plate 17 which is fitted in the upper end of the body section 15. The upper surface of the top plate 17 is the board surface 7, and the hole portions 8 are formed to the top plate 17.

Figure 5:
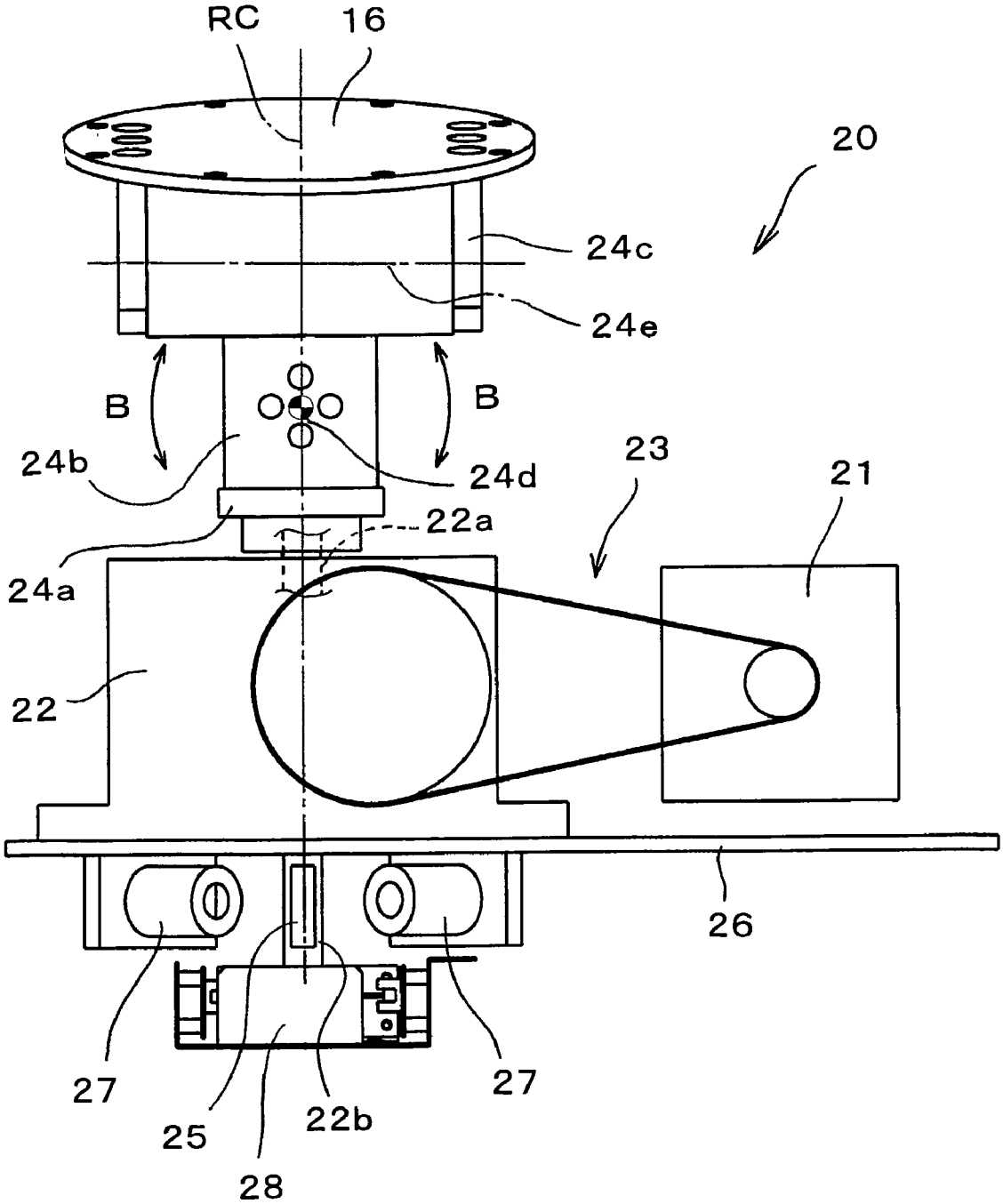
FIG. 5 is a front view of a rotation driving device provided to the game machine.
Figure 6:
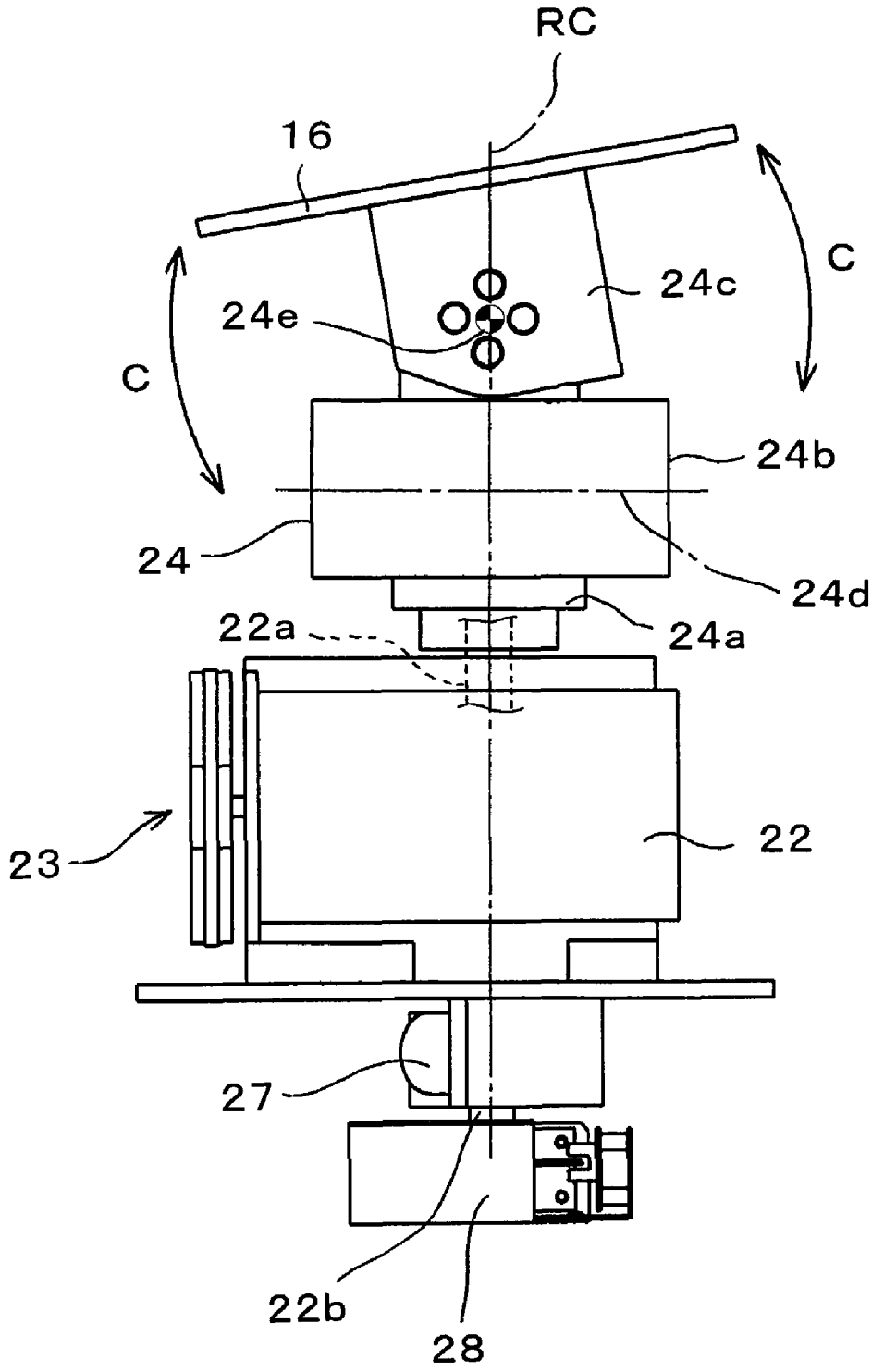
FIG. 6 is a right side view of the rotation driving device.
Figure 7:
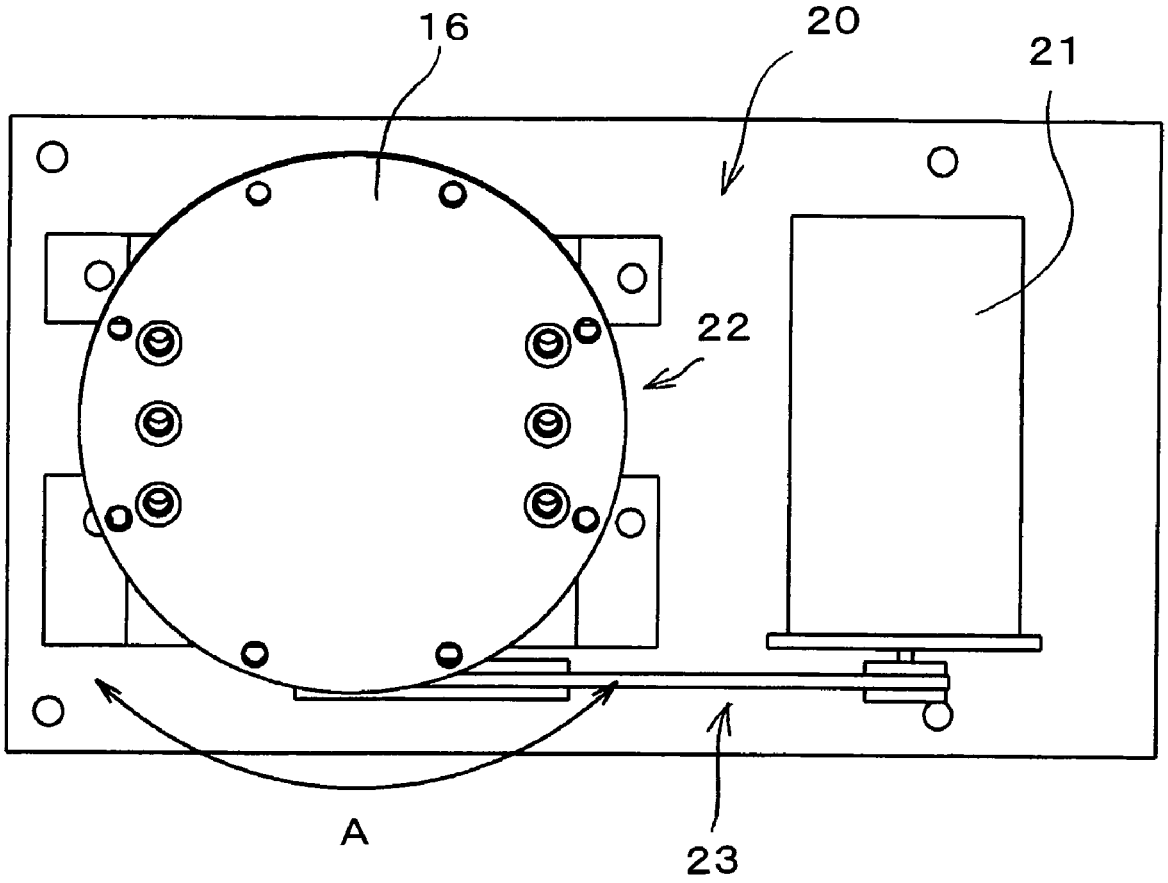
FIG. 7 is a plan view of the rotation driving device.

A rotation driving device 20 is, providing into the supporting pedestal 2. FIG. 5 is a front view of the rotation driving device 20; FIG. 6 is a right side view thereof; and FIG. 7 is a plan view thereof. As is clear from FIGS. 5 to 7, the rotation driving device 20 has an electric motor 21 (or simply, a motor) as a driving source, a reduction gear 22 which reduces a rotational speed of the motor 21, a belt transmission mechanism 23 which transmits the rotation of the motor 21 to the reduction gear 22, and a connector 24 which connects an output shaft 22*a* of the reduction gear 22 and the game board 3. The output shaft 22*a* extends to near vertical, and the center line of the output shaft 22*a* is equivalent to a pivot axis line RC of the game board 3. The connector 24 has a first connecting section 24*a* which is fixed to the output shaft 22*a* so as to be rotated integrally with the output shaft 22*a*, a rotation section 24*b* which is connected with the first connecting section 24*a*, and a second connecting section 24*c* which is connected with the rotation section 24*b*. The rotation section 24*b* is connected with the first connecting section 24*a* rotatably about a first rotation axis line 24*d* which is perpendicular to the pivot axis line RC; and the second connecting section 24*c* is connected with the rotation section 24*b* rotatably about a second rotation axis line 24*e* which is perpendicular to both the pivot axis line RC and the first rotating axis line 24*d*. Further, the second connecting section 24*c* is integrally jointed to the bottom plate 16 of the game board 3.

According to the connector 24, the game board 3 is connected with the output shaft 22*a* so as to be rotated about the pivot axis line RC (see an arrow A in FIG. 7) when the output shaft 22*a* is driven to rotate. By connecting the rotating motion of the rotation section 24*b* (an arrow B in FIG. 5) with respect to the first connecting section 24*a* and the rotating motion of the second connecting section 24*c* (an arrow C in FIG. 6) with respect to the rotation section 24*b*, the game board 3 can be tilted toward all directions with respect to the pivot axis line RC.

A lower end portion of the output shaft 22*a* protrudes beneath the reduction gear 22, and a key 25 is attached to the protruded portion 22*b*. A pair of stoppers 27, which is able to be brought in contact with the key 25, is arranged on a base plate 26 on which the reduction gear 22 is mounted. The key 25 pushes against one of the stoppers 27 in a course of the rotation of the output shaft 22*a*. Thus, a rotation range of the output shaft 22*a*, eventually the game board 3, is limited. As shown in FIGS. 5 and 6, when the output shaft 22*a* is at the center of the rotation range, the game board 3 is positioned so that the bottom plate 16 is tilted downwardly toward the forward of the front-rear direction of the game machine 1 and the bottom plate 16 is leveled in the right-left direction of the game machine 1 from the left end to the right end. The position of the game board 3 shown in FIGS. 5 and 6 is referred as a neutral position.

As is clear from FIG. 4, the top plate 17 of the game board 3 is approximately parallel to the bottom plate 16. Thus, the board surface 7 of the game board 3 is also tilted downwardly toward the player's side similarly to the bottom plate 16, when the game board 3 is in the neutral position. The limit of the rotation angle of the output shaft 22*a* is set to about 45 deg. each for the right and left direction, totally 90 deg. Further, a rotation angle detector 28 which detects the rotation angle of the output shaft 22*a* is arranged at a lower end of the protruded portion 22*b*. The rotation angle detected by the rotation angle detector 28 is utilized to determine the rotation angle of the game board 3 with respect to the neutral position.

Figure 8:
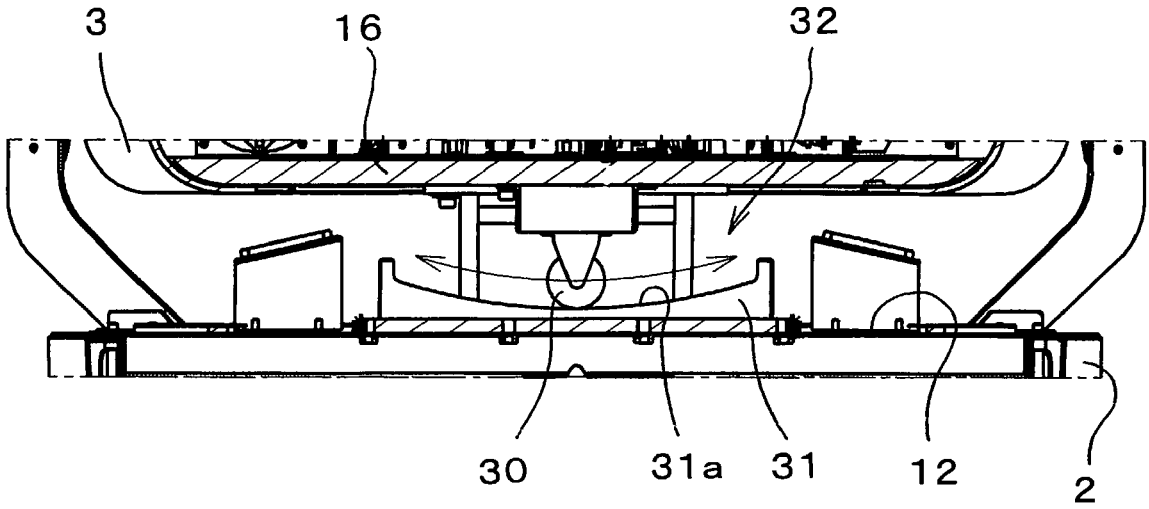
FIG. 8 is an enlarged view of a tilt giving mechanism provided between a supporting pedestal and a game board.
Figure 9:
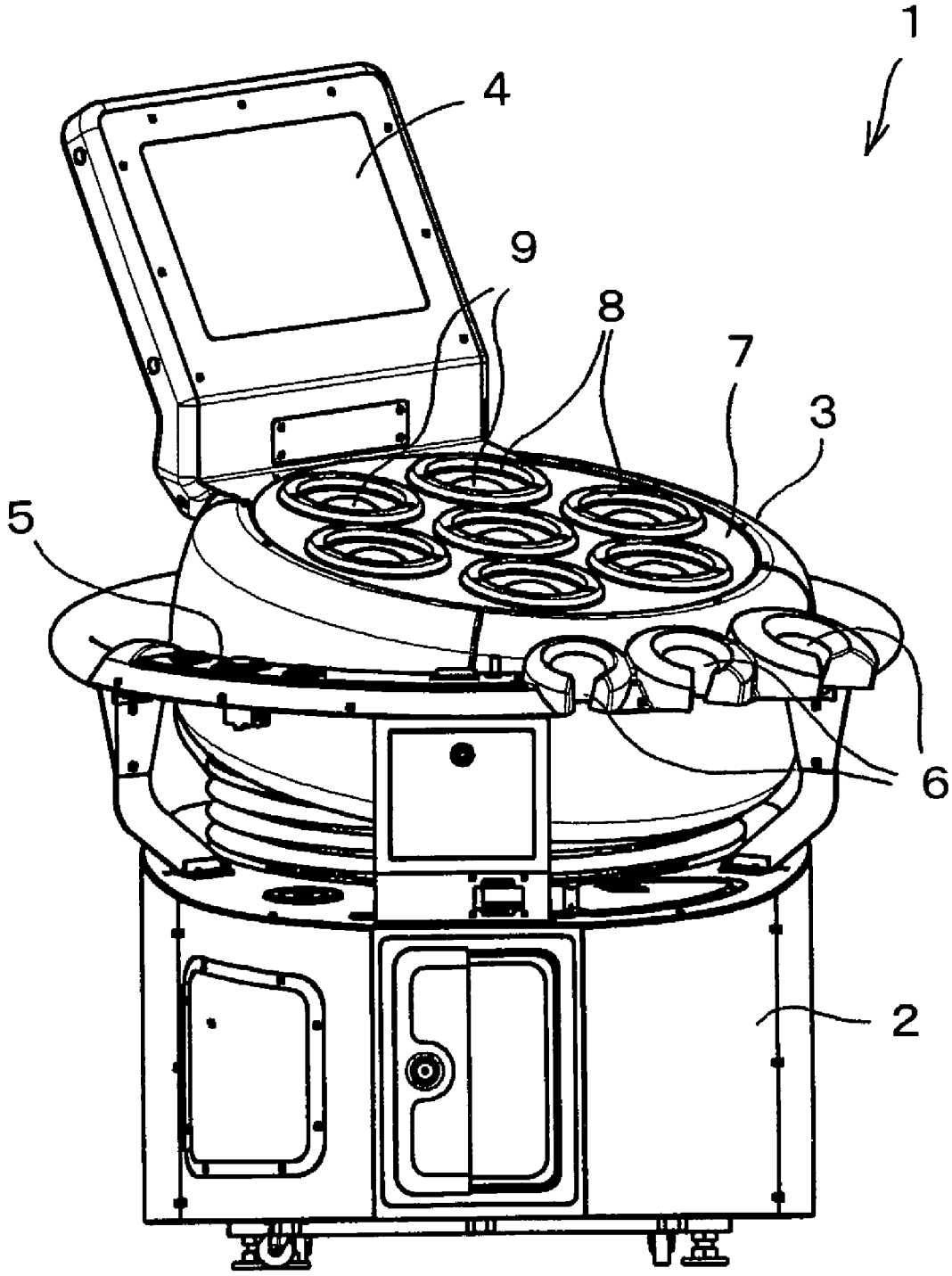
FIG. 9 is a perspective view of the game board in a position rotated counterclockwise from a neutral position.

As shown in FIGS. 2, 4 and 8, a caster 30 is attached to the bottom plate 16 of the game board 3 as a guide member in order to support the game board 3 with the top plate 12 of the supporting pedestal 2. The caster 30 bears a part of the weight of the game board 3, and is seated on a guide surface 31*a* of a guide member 31 fixed on the top plate 12. When the caster 30 is seated on the guide surface 31*a*, the tilt of the game board 3 is uniquely determined with respect to the pivot axis line RC. That is, the tilt of the game board 3 cannot be fixed by just connecting the output shaft 22*a* with the game board 3 via the connector 24, since the second connecting section 24*c* of the connector 24 can be tilted toward all directions with respect to the output shaft 22*a*. However, the tilt of the game board 3 can be set uniquely by bringing the caster 30 to run on the guide surface 31*a* by using the weight of the game board 3, thereby preventing a free tilt of the game board 3.

The guide surface 31*a* extends in an arc-shape convexly curved in a down direction. When the game board 3 is in the neutral position, the caster 30 is seated on the bottom of the guide surface 31*a*, namely, the central lowest position. In other words, the guide surface 31*a* has a difference of elevation from its bottom where the caster 30 contact with the guide surface 31*a* when the game board 3 is in the neutral position, such that the height increases in an up-down direction (the direction of the pivot axis line RC) as being separated from the bottom in the rotating directions of the game board 3. Therefore, when the game board 3 is rotated with respect to the neutral position by the rotation driving device 20, the caster 30 runs up along the guide surface 31*a*. Accordingly, the game board 3 is tilted with respect to the pivot axis line direction in accordance with the rotation angle from the neutral position. For example, in the case when the game board 3 is driven to rotate counterclockwise from the neutral position, the game board 3 is tilted downwardly toward the right. As is clear from this, the tilt giving mechanism 32 is constituted from the caster 30 and the guide member 31 in this embodiment.

Figure 10:
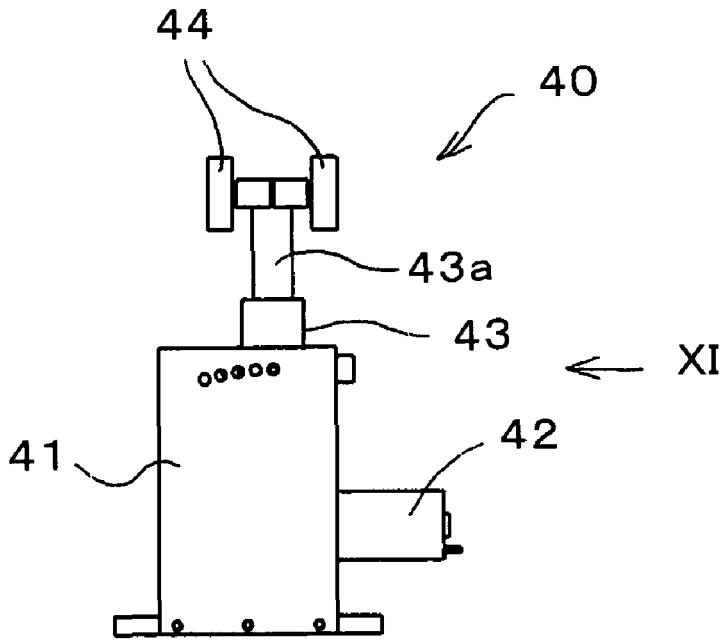
FIG. 10 is a front view of a lift mechanism provided to the game machine.
Figure 11:
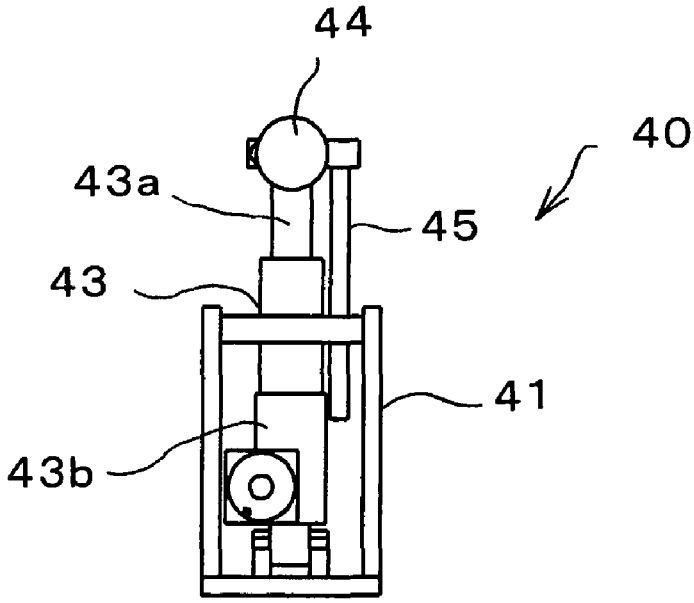
FIG. 11 is a side view of the lift mechanism viewed from a direction of an arrow XI in FIG. 10.

As shown in FIG. 4, a lift mechanism 40 is arranged at the rear of the supporting pedestal 2. As shown in FIGS. 10 and 11, the lift mechanism 40 has a housing 41, an electric motor 42 attached to the housing 41, a ball screw 43 which converts the rotation of the motor 42 into a linear motion, a caster 44 attached at an end of a screw shaft 43*a* of the ball screw 43, and a guide rod 45 which is fixed to the housing 41 movably along a direction parallel to the screw shaft 43*a*. The housing 41 is fixed inside the supporting pedestal 2. A nut 43*b* of the ball screw 43 is fixed on the housing 41 rotatably about the screw shaft 43*a* but immovably in a direction of the screw shaft 43*a*. Further, an upper end of the guide rod 45 is connected with the caster 44, and thus the screw shaft 43*a* is stopped to rotate. The motor 42 is employed to rotate the nut 43*b*, and the screw shaft 43*a* is moved in an axial direction by the rotation of the nut 43*b*.

Figure 12:
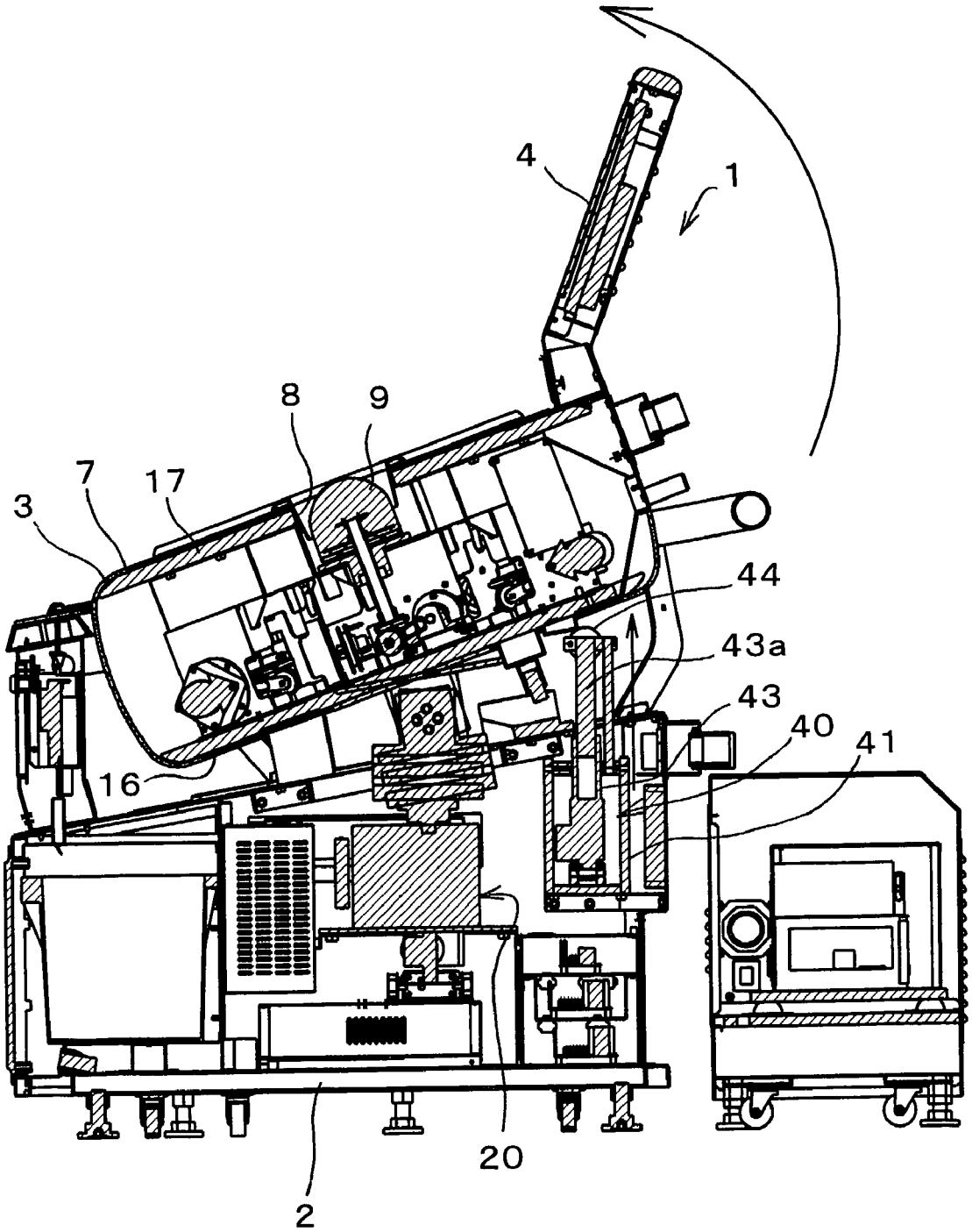
FIG. 12 is a vertical cross-sectional view of the game board when the rear portion of the game board is lifted by the lift mechanism.

As shown in FIG. 4, the housing 41 is mounted in the supporting pedestal 2 with the caster 44 retreating beneath the bottom plate 16 of the game board 3 when the screw shaft 43*a* of the ball screw 43 is moved to the lowest end of the moving range. When the screw shaft 43*a* of the ball screw 43 moves up and brings the caster 44 to hit against the bottom plate 16 of the game board 3 as shown in FIG. 12, the rear of the game board 3 is lifted so that the game board 3 is tilted downwardly toward the front thereof about the connector 24. Accordingly, the caster 30 of the tilt giving mechanism 32 leaves from the guide member 31, thereby the tilt of the board surface 7 of the game board 3 increases with respect to the horizontal direction.

According to the game machine 1 having the above configuration, the game board 3 can be rotated in right and left directions from the neutral position by the rotation driving device 20; and furthermore, the game board 3 can be tilted with respect to the pivot axis line RC by the tilt giving mechanism 32 along with the rotating motion. Since the board surface 7 can be moved complexly with these operations, the motions of the targets 9 can be diversified and the unpredictability of the motions of the targets 9 can be increased by allowing the targets 9 to appear and disappear from and into the hole portions 8 in accordance with the motion of the board surface 7, thereby to enhance the appeal of the game. The tilt of the board surface 7 can be further varied with the lift mechanism 40, thereby to further diversity the motions of the targets 9.

In the game machine 1 of this embodiment, the rotation can be transmitted efficiently from the rotation driving device 20 to the game board 3, since the game board 3 is connected with the output, shaft 22*a* of the rotation driving device 20 via the connector 24. When the game board 3 is connected with the output shaft 22*a* via the connector 24, the game board 3 can be restrained on the pivot axis line RC. In other words, the game board 3 can be retained on the pivot axis line RC by the rotation driving device 20. Accordingly, wobbling of the game board 3 about the pivot axis line RC or the slip of the pivot axis line can be suppressed when the game board 3 rotates, thereby to improve the stability of the rotating motion with relative ease. As to the tilt of the game board 3 with respect to the pivot axis line RC, it is only necessary to support the game board 3 on the supporting pedestal 2 in at least another point since the game board 3 is restrained by the connector 24. Therefore, the supporting mechanism of the game board 3 is simplified easily. The guide surface 31*a* is formed in a curve surface in which the height from its bottom where the caster 30 contact with guide surface 31*a* when the game board 3 is in the neutral position increase as being separated from the bottom in the rotating directions of the game board 3. Thus, the game board 3 can be more tilted as the rotation angle increases from the neutral position, thereby to change the motions of the targets 9 more dynamically. By rotating the game board 3 which is tilted downwardly toward the forward from the neutral position, the board surface 7 is tilted in one side to a diagonal direction with respect to the player, and the tilt is further varied by the tilt given by the tilt giving mechanism 32. Accordingly, the target 9 which moves toward the player's side in the neutral position changes its motion to different directions, and thus the player is requested to change the way of hitting the target 9. Through these changes, monotonous motions of the targets are diversified, and the appeal of the game can be enhanced.

Figure 13:
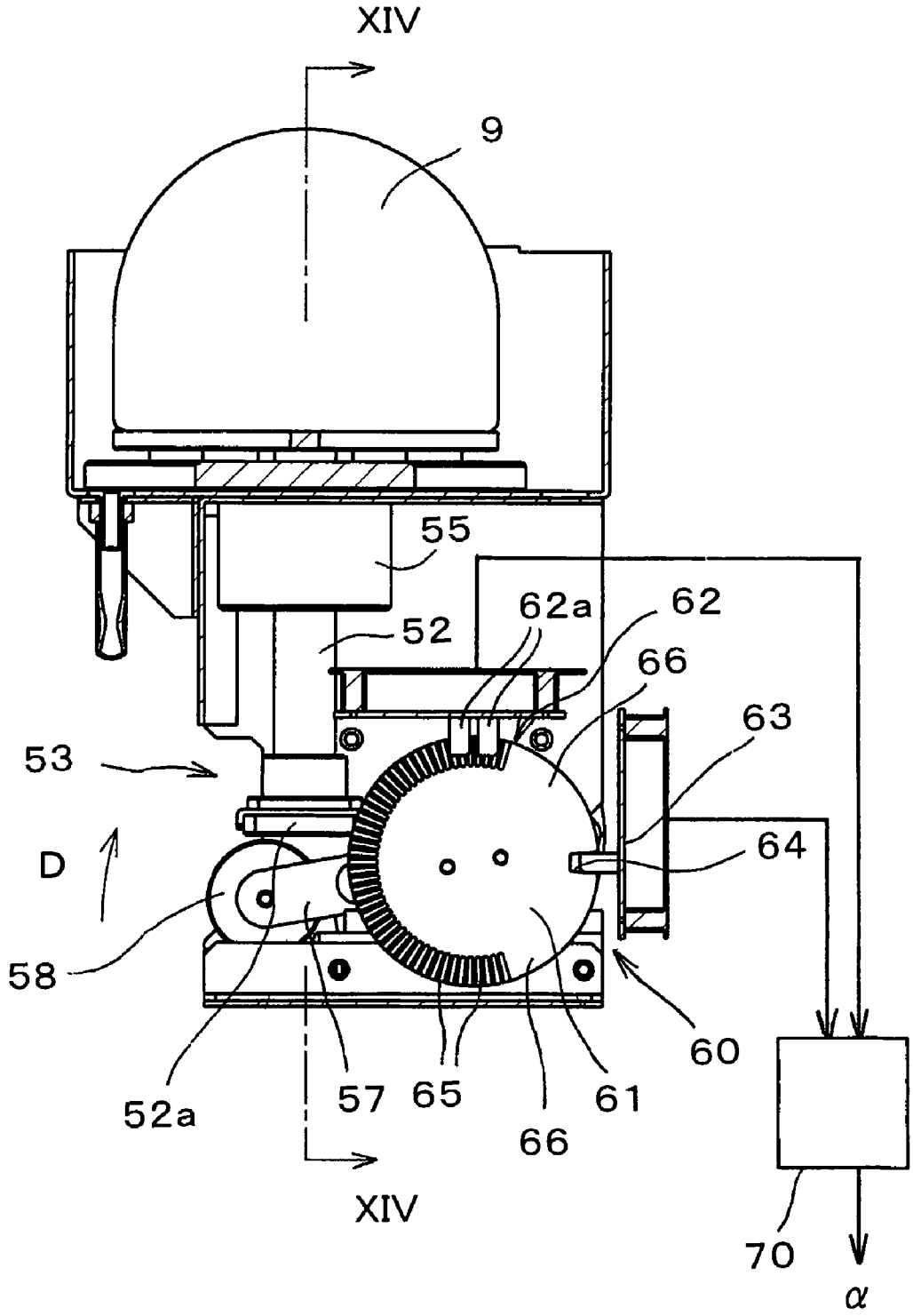
FIG. 13 is a diagram illustrating a target driving mechanism provided into the game board.
Figure 14:
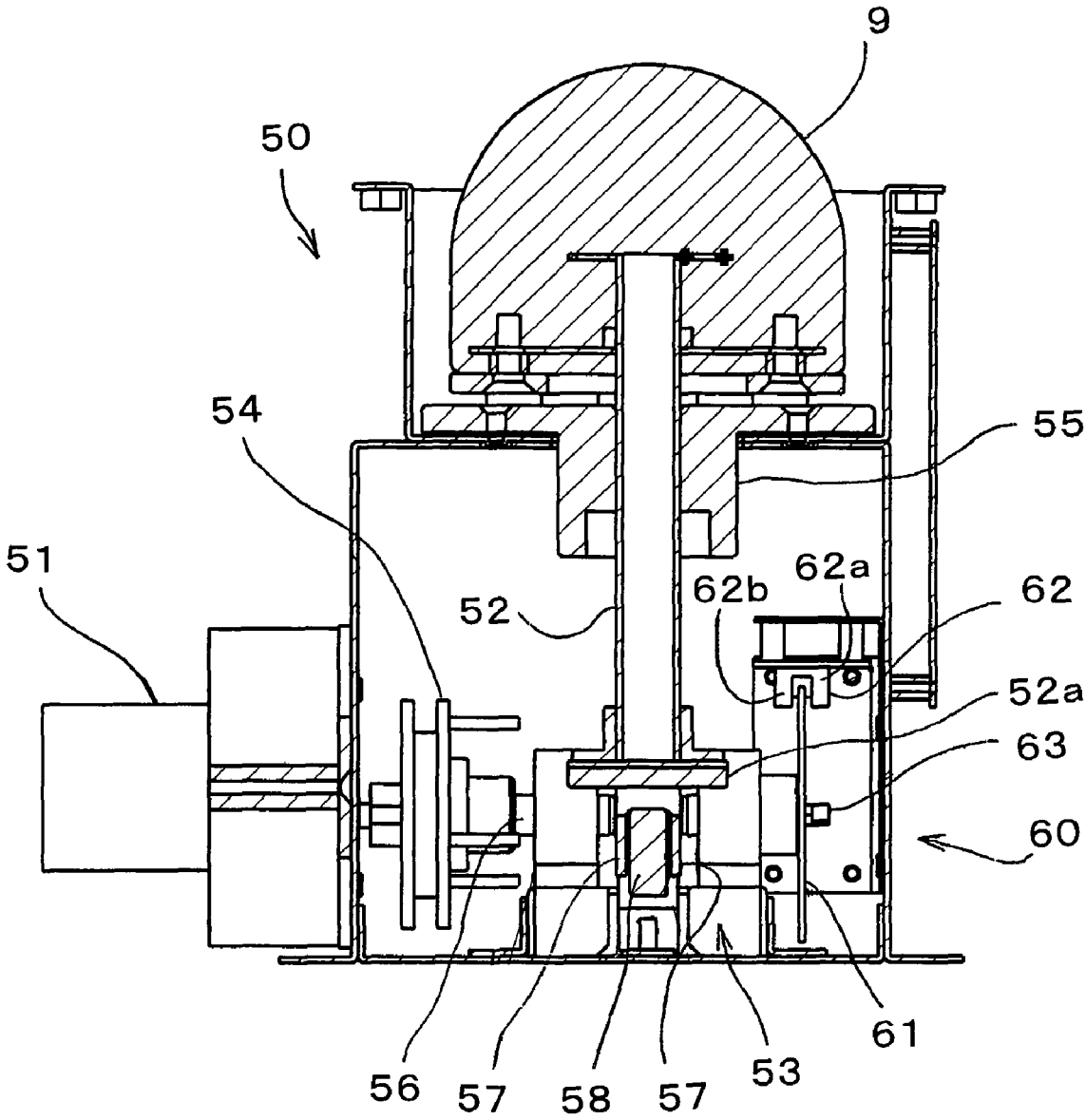
FIG. 14 is a cross-sectional view of the target driving mechanism taken along line XIV-XIV in FIG. 13.

An example of the configuration for allowing the targets 9 to appear and disappear from and into the hole portions 8 is described below. A target driving mechanism 50 is arranged inside the game board 3. A target driving mechanism 50 is employed for each target 9. The target driving mechanism 50 drives to move the target between the position where the target protrudes over the hole portion 8 and the position where it retreats into the hole portion 8. FIGS. 13 and 14 show the target 9 in a retreated position. The position of the target 9 in FIG. 13 is referred as an original position. The target 9 has a shape of a cylinder in which a top end of the cylinder is rounded in a hemispheric shape; however, the target 9 is not limited to this form and can be modified suitably.

The target driving mechanism 50 has an electric motor 51 as a driving source, a target driving shaft 52 which protrudes downwardly from the target 9 along its center line, a motion converting mechanism 53 which converts the rotating motion of the motor 51 to a linear motion in an axial direction of the target driving shaft 52, and a clutch 54 which is arranged between the motor 51 and the motion converting mechanism 53. That is, the target driving mechanism 50 transmits the rotation of the motor 51 to the motion converting mechanism 53 via the clutch 54, and the motion converting mechanism 53 converts the rotating motion to a linear motion in the axial direction (up-down direction) of the target driving shaft 52, so that the target 9 moves up and down. The motion transmission mechanism is constituted from the clutch 54, the motion converting mechanism 53 and the target driving shaft 52. The target driving shaft 52 is guided in an up-down direction by a roller bearing 55. The motion converting mechanism 53 has an input shaft 56 to which the rotation from the clutch 54 is transmitted, an arm 57 which is swung about the input shaft 56, and a roller 58 which is arranged to an end of the arm 57. When the arm 57 is driven to swing in a direction of an arrow D in FIG. 14 by the rotation of the input shaft 56, the roller 58 is brought in contact with a flange portion 52*a* at the lower end of the target driving shaft 52 so as to push it up, so that the target driving shaft 52 moves up and the target 9 protrudes from the hole portion 8. For the motion converting mechanism 53, a suitable mechanism such as a cam mechanism, a crank mechanism, a rack pinion or a screw mechanism may be used. When the target 9 is moved down after the hitting, the clutch 54 separates a motion transmission path between the input shaft 56 of the motion converting mechanism 53 and the motor 51. Thus, overloaded input to the motor 51 is prevented, or resistance to the moving-down motion of the target 9 is suppressed.

A motion detecting device 60 that detects the motion of the target 9 is attached to the target driving mechanism 50. The motion detecting device 60 has a disc-shape detecting plate 61 which is fixed integrally and rotatably to the input shaft 56 of the motion converting mechanism 53, a first sensor 62 which is arranged over an outer periphery of the detecting plate 61, and a second sensor 63 which is arranged over the outer periphery of the detecting plate 61 and separately from the first sensor 62 in a peripheral direction. As shown in FIG. 13, a reference slit 64 and multiple count slits 65 arranged with a constant pitch in the peripheral direction are arranged on the outer periphery of the detecting plate 61. A closed zone 66 where no slit is arranged is employed between the reference slit 64 and the count slits 65. The first sensor 62 is an optical sensor having two pairs of light projecting sections 62*a* and light receiving sections 62*b* which are arranged so as to sandwich the detecting plate 61, and outputs a detection signal of the count slit 65 when light beams emitted from the projecting section 62*a* of the respective pairs are detected by the light receiving section 62*b*. The detected signals are output separately from the respective pairs of the projecting sections 62*a* and the light receiving sections 62*b*. The pitch between the projecting sections 62*a* in the peripheral direction is non-integral multiple of the half of the pitch between the count slits 65. Also the second sensor 63 is a similar optical sensor, but has only a pair of a projecting section and a light receiving section.

When the target 9 is in the original position, the first sensor 62 faces a region where the count slits 65 are arranged, more specifically, a head region in the rotating direction (see the arrow D) when the target 9 is moving up, and the second sensor 63 faces the reference slit 64. In the case when the target 9 moves up from the original position, the first sensor 62 outputs two pairs of pulse strings of the detected signals at a cycle according to the pitch between the count slits 65 and the rotating speed of the detecting plate 61. On the other hand, the second sensor 63 does not output the detected signal until the second sensor 63 reaches the first count slit 65 after passing through the closed zone 66, and outputs the pulse strings of the detected signal after the first count slit 65 is detected.

The signal detected by the motion detecting unit 60 is processed by a signal processing unit/device 70. The signal processing unit 70 is a computer unit using a microprocessor, and determines the operating state of the target 9 based on the detected signals output from the sensors 62 and 63. For example, the signal processing unit 70 determines whether the target 9 is in the original position in FIG. 13 based on the detected signal from the second sensor 63. Further, in the case when the signal processing unit 70 determines that the target 9 is not in the original position based on the signal from the second sensor 63, it determines the operating state of the target 9 by executing a motion determining routine shown in FIG. 15. The motion determining routine is repeated at a constant cycle when the target 9 is not in the original position.

Figure 15:
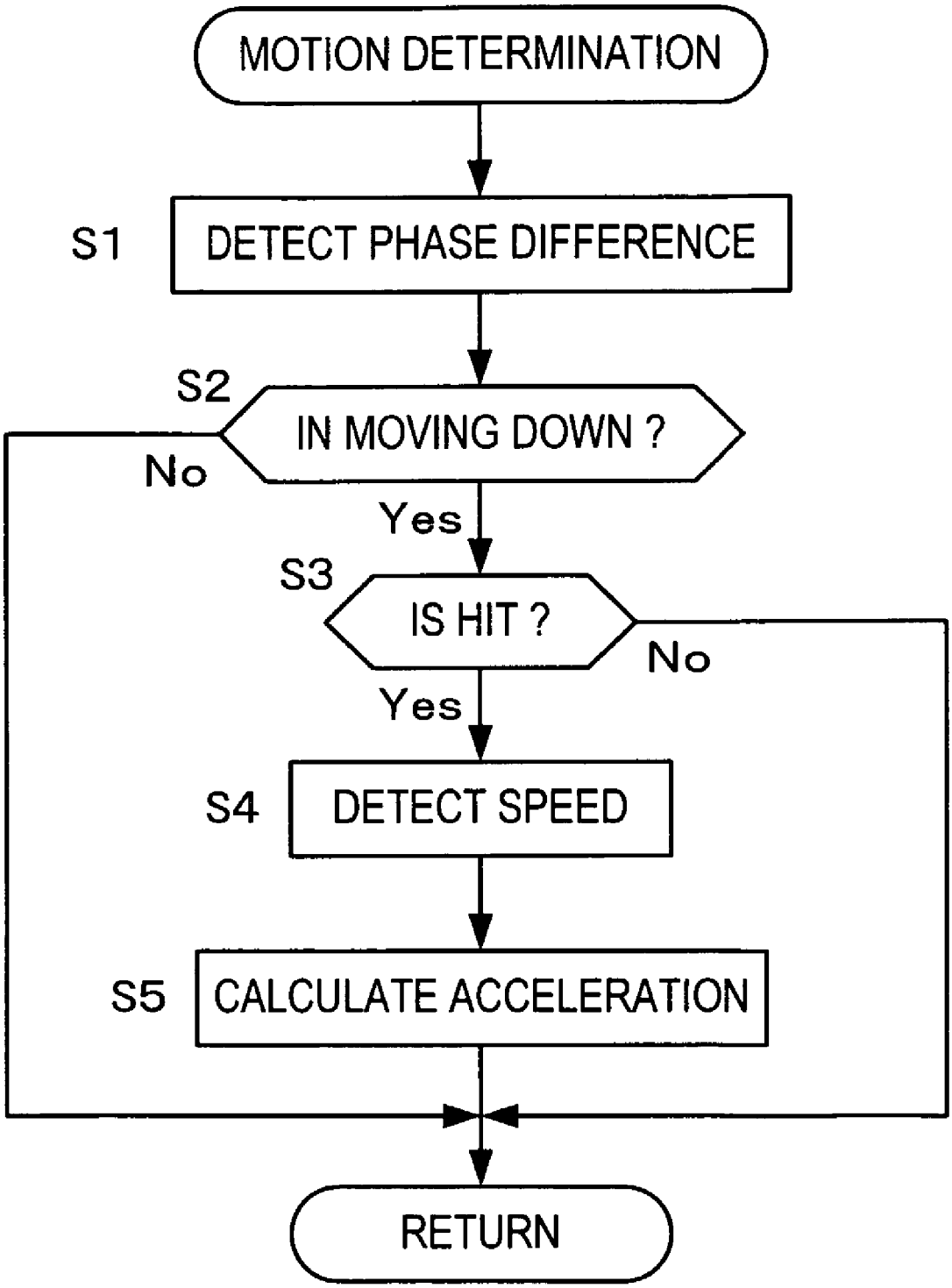
FIG. 15 is a flowchart illustrating a motion determining routine executed by a signal processing unit in FIG. 13.

In the motion determining routine of FIG. 15, the signal processing unit 70 detects a phase difference between the pulse strings of the detected signal output from the first sensor 62 (in step S1), and determines based on the phase difference whether the target 9 is in a course of moving down (in step S2). That is, when the target 9 moves, the light receiving sections 62*b* of the first sensor 62 output the pulse strings having the same cycle with the phase difference according to their pitch. The phase difference between the obtained pulse strings differs from a half of the cycle of the pulse strings, since the pitch of the light receiving sections 62*b* is set to be non-integer multiple of the half of the pitch of the count slits 65. Accordingly, when a pulse string is used as a reference, a shift amount of the other pulse string varies depending on a delay or a lead on a time axis line, and the relation of the magnitudes of the shift amounts in both directions is reversed in accordance with the rotating direction of the detecting plate 61. Therefore, the rotating direction of the detecting plate 61 can be determined based on the phase difference of the pulse strings; and the moving direction of the target 9 can be determined based on a relationship between the rotating direction of the detecting plate 61 and the moving direction of the target 9. When the target 9 is detected moving down, the sequence advances to step S3. The signal processing unit 70 determines whether the moving-down motion is caused by the hitting of the target 9, for example, by comparing the cycle of the pulse strings of the detected signal when the moving-down motion is caused by the hitting of the target 9 with the cycle of the pulse strings generated when the target 9 is moved down by driving the motor 51. When it is determined that the target 9 is hit, the signal processing unit 70 advances to step S4 and detects a moving-down speed of the target 9 based on the cycle of the pulse string output from the first sensor 62. The signal processing unit 70 calculates an acceleration of the target 9 by differentiating the detected speed in step S5. When step S5 is completed, the whole routine is ended.

The acceleration thus obtained is proportional to a force exerted by hitting the target 9. Therefore, the force of the user's hitting on the target 9 can be obtained by outputting the acceleration obtained in step S5 from the signal processing unit 70 as an acceleration signal $\alpha$, and inputting the acceleration to a control unit (not shown) of the game machine 1, and the obtained force can be reflected on the game process such as setting of a score or a level of difficulty. The signal processing unit 70 may be provided as a function block of a part of the control unit of the game machine 1.

The present invention is not limited to the above embodiment, and can be carried out in various forms. For example, the pivot axis line of the game board 3 is not limited to the vertical direction, and may be set to an arbitrary direction as long as it extends to a direction of intersecting with the board surface 3. Further, in the above embodiment, transmission of the rotation to the game board 3 and allowance of the tilt of the game board 3 are implemented by connecting the output shaft 22*a* of the rotation driving device 20 with the game board 3 via the connector 24 and allowing the connector 24 to tilt toward all directions about the pivot axis line RC. However, the connector 24 is not always necessary. For example, a roller or the like is brought into contact with the outer periphery or the inner periphery of the game board 3 so that the rotation is transmitted, and the tilt giving mechanism which gives a tilt to the game 3 according to the rotating motion of the game board 3 is provided between the game board 3 and the supporting pedestal 2, so that the motions similar to those of the game machine in the above embodiment can be given to the game board. Even when the connector 24 is employed, the connector 24 is not limited to the configuration shown in the drawings, and various universal connectors may be used. As to the tilt giving mechanism, the caster 30 may be arranged to the supporting pedestal 2, and the guide member 31 may be arranged to the game board 3. Various configurations are applicable to the tilt giving mechanism.

In the above embodiment, the targets 9 are allowed to appear and disappear in an approximately up-down direction from the board surface 7 of the game board 3. However, the present invention is applicable to a game machine which is configured so that the targets are allowed to appear and disappear from and into the housing portions in an approximately front-rear direction of the game machine. The tilt giving mechanism is not limited to the above configuration. In the above embodiment, the tilt of the guide surface 31*a* of the guide member 31 is set to be larger as the rotation angle of the game board 3 increases with respect to the neutral position, by curving the guide surface 31*a* in an arc shape. However, the tilt of the game board 3 is not limited to this change and can be changed suitably. For example, the game board 3 may be tilted in various forms by forming the complex undulation on the guide surface 31*a*.

The invention claimed is:

1. A game machine, comprising:

a game board having a board surface and a housing section opened on the board surface;

a target which is provided to the housing section so as to freely appear and disappear;

a target driving mechanism which is provided into the game board and drives the target between a position where the target protrudes from the housing section and a position where the target retreats into the housing section;

a supporting pedestal which supports the game board;

a rotation driving device which rotates the game board supported by the supporting pedestal about a pivot axis line extending to a direction where the line crosses the board surface in a reciprocating motion; and a tilt giving mechanism which is provided between the supporting pedestal and the game board and gives a motion for tilting with respect to the pivot axis line to the game board according to a rotating motion of the game board about the pivot axis line.

2. The game machine according to claim 1, wherein the rotation driving device has an output shaft which is arranged on the pivot axis line, a driving source which drives to rotate the output shaft, and a connector which allows a tilt of the game board to all directions with respect to the pivot axis line and simultaneously connects the output shaft and the game board so as to be capable of rotating integrally.

3. The game machine according to claim 1, wherein the tilt giving mechanism has a guide member which has a guide surface extending about the pivot axis line and is provided to any one of the supporting pedestal and the game board, and a guided member which is provided to the other one of the supporting pedestal and the game board and contacts with the guide surface of the guide member, and the guide surface has a difference of elevation in a direction of the pivot axis line.

4. The game machine according to claim 3, wherein the guide surface is constituted so that a contact position of the guided member at the time when the game board is in a neutral position at the middle of a rotating range is a bottom, and as the game board separates from the bottom to farther its rotating direction, its height increases.

5. The game machine according to claim 3, further comprising a lift mechanism which elevates the game board so that the guided member is separated from the guide surface.

6. The game machine according to claim 1, wherein when the game board is in the neutral position at the center of the rotating range, a tilt is given to the board surface of the game board so that the game board tilts forward and downward with respect to a player, and the target is allowed to appear and disappeared from and into the board surface in an approximately up-down direction.

7. The game machine according to claim 2, wherein the tilt giving mechanism has a guide member which has a guide surface extending about the pivot axis line and is provided to any one of the supporting pedestal and the game board, and a guided member which is provided to the other one of the supporting pedestal and the game board and contacts with the guide surface of the guide member, and the guide surface has a difference of elevation in a direction of the pivot axis line.

8. The game machine according to claim 7, wherein the guide surface is constituted so that a contact position of the guided member at the time when the game board is in a neutral position at the middle of a rotating range is a bottom, and as the game board separates from the bottom to farther its rotating direction, its height increases.

9. The game machine according to claim 7, further comprising a lift mechanism which elevates the game board so that the guided member is separated from the guide surface.

10. The game machine according to claim 4, further comprising a lift mechanism which elevates the game board so that the guided member is separated from the guide surface.

11. The game machine according to claim 8, further comprising a lift mechanism which elevates the game board so that the guided member is separated from the guide surface.

* * * * *